United States Patent [19]

Shaub

[11] 4,240,991

[45] Dec. 23, 1980

[54] HUMIDIFIER

[75] Inventor: Melvin H. Shaub, Lancaster, Pa.

[73] Assignee: Armstrong Cork Company, Lancaster, Pa.

[21] Appl. No.: 63,579

[22] Filed: Aug. 3, 1979

[51] Int. Cl.[3] ..... B01F 3/04

[52] U.S. Cl. ..... 261/92; 98/105; 98/109; 261/DIG. 15; 137/453; 416/176

[58] Field of Search ..... 261/92, DIG. 15; 137/453; 416/197, 176, 197 A; 98/105, 109

[56] References Cited

U.S. PATENT DOCUMENTS

| | | | |
|---|---|---|---|
| 249,719 | 11/1881 | Woodhouse | 261/92 |
| 526,653 | 9/1894 | Iliowizi | 98/105 |
| 544,175 | 8/1895 | Iliowizi | 98/109 |
| 900,356 | 10/1908 | Comins | 261/92 |
| 1,024,700 | 4/1912 | Rikhoff | 416/197 A |
| 1,189,600 | 7/1916 | Mallett et al. | 261/92 |
| 1,389,241 | 8/1921 | Clefton | 137/453 |
| 1,806,021 | 5/1931 | Perkins | 261/92 |
| 1,846,057 | 2/1932 | Ilg | 261/92 |
| 2,170,576 | 8/1939 | Shaver | 261/92 |
| 2,175,779 | 10/1939 | Mohrdieck | 261/92 |
| 2,179,470 | 11/1939 | Larsen | 261/92 |
| 2,202,235 | 5/1940 | Smith | 261/92 |
| 2,210,354 | 8/1940 | Bates | 261/92 |
| 2,596,324 | 5/1952 | Carpenter et al. | 261/92 |
| 3,227,064 | 1/1966 | Spangle | 98/109 |
| 3,287,002 | 11/1966 | Sevald | 261/92 |
| 3,437,318 | 4/1969 | Abbott et al. | 261/DIG. 15 |
| 3,441,256 | 4/1969 | Worsfold | 261/92 |
| 4,056,049 | 11/1977 | Stuckey | 98/105 |

*Primary Examiner*—Tim R. Miles

[57] ABSTRACT

Disclosed is a self-contained evaporator type humidifier adapted to be positioned at an outlet opening of a warm air heating system and operated solely by an air stream issuing therefrom. The humidifier includes a housing provided with an air inlet opening and an exhaust air grill. A water receptacle, an adjustable water supply means, and an adjustable air-water contacting member are provided within the housing. The air-water contact member comprises a frame having a water-absorbent covering thereon and has an overall shape which is approximately that of a propeller which has been twisted at the midpoint of its longitudinal axis so that the end portions which are substantially in the shape of an elongated S, lie in planes which are generally perpendicular to each other. The air-water contact member is mounted for free rotation in journals at each end of the interior of the housing and is rotated around its longitudinal axis by the direct impingment thereon of the air stream from the heating system. As the member rotates, its configuration results in portions of alternate halves thereof moving through the water in the receptacle with a "slicing" action, thus reducing resistance to its turning and enabling it to be rotated by relatively low air velocities. Water is evaporated from the air-water contact member by the air current passing thereover.

9 Claims, 6 Drawing Figures

HUMIDIFIER

BACKGROUND OF THE INVENTION

1. Field of the Invention

This invention relates to a self-contained evaporator type humidifier adapted to be positioned in and operated solely by an air stream issuing from an exhaust outlet of a warm air heating system. More particularly, the invention relates to such a humidifier comprising a housing having an air inlet opening and an air exhaust grill, a water receptacle and water supply means mounted in the housing and an air-water contacting member mounted for free rotation in journals at each end of the housing and adapted to be directly driven by the air stream from the heating system.

2. Description of the Prior Art

The prior art shows that it is broadly known to provide self-contained humidifiers which are adapted to be attached to hot air registers or to be positioned in the outlet opening of a warm air heating system and operated solely by an air stream issuing therefrom. It is also known to provide an evaporator type humidifier of this kind in which an air-water contact member is exposed to an air stream and the air stream is humidified by the molecular transfer of water into the air stream by evaporation.

U.S. Pat. No. 81,695 relates to a humidifier which is adapted to be attached to a hot air register. A water reservoir and a fan which is driven by the air issuing from the register are provided in the humidifier housing. In this arrangement, the heated air contacting the reservoir produces a vapor that rises and mixes with the hot air which is passed into the room through exhaust openings in the housing by means of the fan.

U.S. Pat. No. 4,145,384 relates to an evaporator-type humidifier designed for installation in a horizontal air duct and is powered by the air passing therethrough. In this arrangement, a non-water-contacting fan wheel located outside of the humidifier housing drives a water-contacting wheel having cups on its periphery which pick up water and discharges it into a trough from which it flows through openings above spaced stationary air-water contact members which are positioned substantially vertically, with their faces generally parallel to the air flow in the duct.

U.S. Pat. No. 526,653; 526,923; and 544,175 relate to humidifiers adapted to be attached to hot air registers and are similar to the previously mentioned humidifier of U.S. Pat. No. 81,695 in that a water reservoir and a fan are provided in the humidifier housing, with the fan being adapted to be operated by means of the air issuing from the register and moving the vapor produced by the hot air contacting the water reservior into the room. In U.S. Pat. No. 526,653, the air comes in from the bottom of the humidifier, and the shape of a housing and water reservoir results in a "nozzle effect" which is stated in the patent as being advantageous. U.S. Pat. No. 526, 923 is slightly different in design and has air exhaust openings in the sides of the housing. U.S. Pat. No. 544,175 is quite similar to the preceding patents but has a slightly different fan and housing design. U.S. Pat. No. 2,678,810 relates to an air-freshener evaporator which has an air-driven fan wheel outside of the housing. Inside of the housing, there is provided a plurality of discs which rotate and extend into liquid in the reservoir.

Liquid is evaporated from the upper portion of the discs exposed to the air flow.

U.S. Pat. No. 3,497,187 relates to an air-rotated power humidifier and shows the use of a mesh or netting on a rotary drum which rotates with the bottom passing through the water in the reservoir. The drum is driven by hot air impinging aginst vanes in the drum which also pass through the water.

The prior art humidifiers are unduly complicated and/or involve features which make their usefulness not completely satisfactory in the wide range of operating conditions in which they normally and frequently would be used.

SUMMARY OF THE INVENTION

The primary object of this invention is to provide a low-cost, simplified, effective humidifier which may be operated by the direct impingment on the air-water contact member of an air stream passing between air inlet and outlet ports in the housing.

Another object of this invention is to provide an improved combination humidifier/air grill which although simple in design, has multiple installation possibilities and low air velocity requirements. It is a further object of this invention to provide a combination humdifier/air grill which may be installed over an existing grill of the floor or wall type and which may be used in place of a base board type floor grill, whether recessed or not, and which may be used strictly as an air grill when air conditioning is employed by simple removal of the air-water contacting member and the water. It is still a further object of this invention to provide an evaporator type humidifier having an improved air-water contact member which is rotated directly by the impingement of the air stream from the heating system thereon and which contacts and passes through the water with substantially reduced resistance, thus requiring only relatively low air velocities for operation.

These and other objects are achieved by the new and improved evaporator type humdifier of this invention.

The humidifier is adapted to be mounted at or in a room air outlet of a warm air heating system. The humidifier includes a housing with a water receptacle in the lower portion thereof. An air inlet port and a humidified air outlet part are also provided in the housing. An air-water contact member having a substantially twisted-propeller-shaped configuration is positioned in the path of an air stream passing from the warm air inlet port in the housing and the humidified air outlet port therein and is rotated by the force of the air stream against the porous-water-absorbent cover thereon. However, it will be noted that the twisted propeller-shaped air-water contact member of this invention rotates around its longitudinal axis as contrasted with the customary rotation of a propeller around the hub of a shaft which is perpendicular to the longitudinal axis of the propeller. Means are provided within the housing for removably and adjustably positioning the air-water contact member relative to the level of water in the water receptacle. This provides a means for regulating the degree of immersion of the member in the water and thus also provides a means for regulating the speed of rotation of the propeller. Means are also provided within the housing for adjustably controlling a water supply means whereby the water level in the water receptacle may be regulated as desired. The configuration of the air-water contact member results in only one of the halves of the member being in contact with the water in the receptacle at any given time. This configuration also results in the air-water contact member being able to pass through water with a "slicing" action which greatly reduces the drag thereon and enables the propeller to be rotated by only relatively low air velocities.

Further benefits and advantages of the invention will become apparent from the consideration of the following description when taken together with reference to the accompanying drawings which specify and show a preferred embodiment of the invention.

DESCRIPTION OF THE PREFERRED EMBODIMENT

Figure 1:
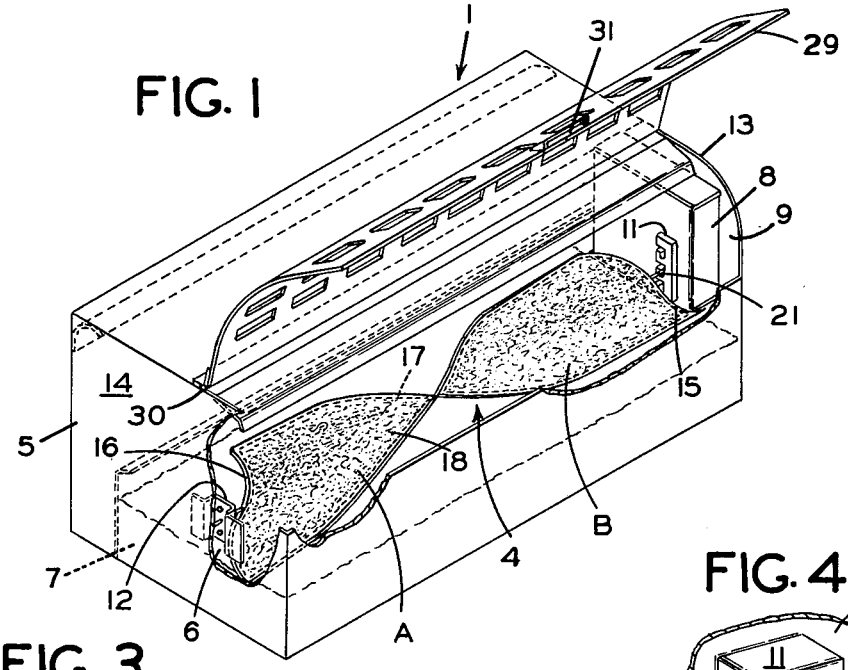
FIG. 1 is an isometric view of a humidifier constructed according to the present invention with portions of the housing broken away to show the air-water contact member and the water supply container within the housing.
Figure 5:
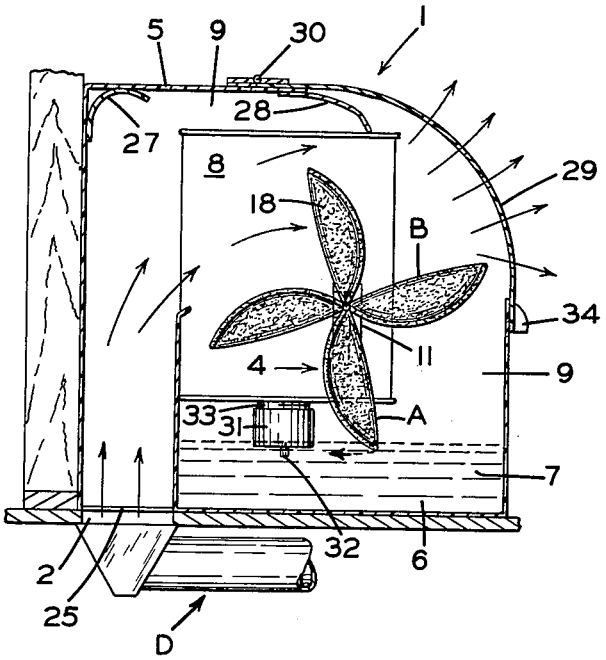
FIG. 5 is an end elevational view partially in section and showing the humidifier of this invention positioned over an air outlet in a floor.
Figure 6:
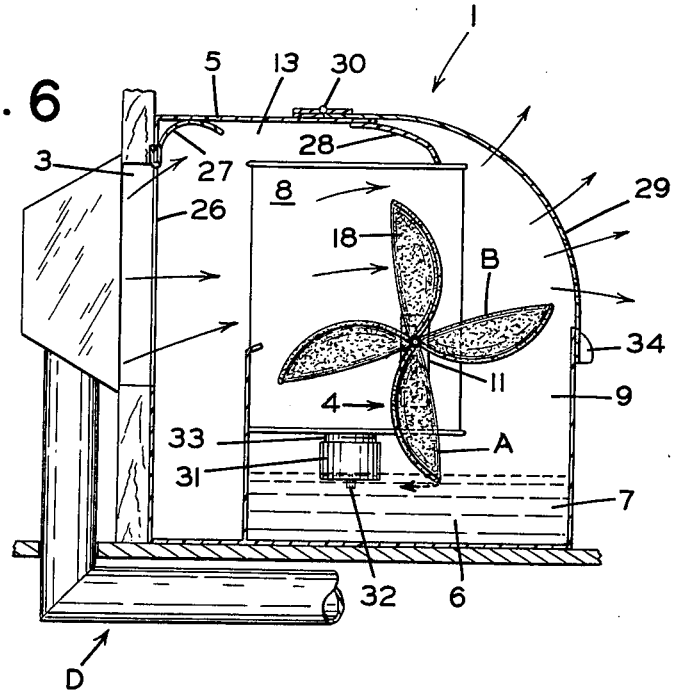
FIG. 6 is a view similar to FIG. 5 but showing the humidifier positioned for operation in conjunction with an air outlet opening in a wall.

Referring now to the drawings, and particularly to FIG. 1, there is illustrated a humidifier apparatus 1 suitable for installation over a floor register 2 or a wall register 3 such as shown in FIGS. 5 and 6, respectively, of a heating or air-conditioning system. The size of the register relative to the humidifier is not critical with respect to the functional operation of the humidifier so long as the humidifier is located adjacent the register and in the air stream issuing therefrom. Obviously, for aesthetic purposes, however, and for the maximum efficiency of operation of the humidifier, it is desirable for the humdifier housing to substantially cover the outlet register of the heating system.

The humidifier is positioned so that its longitudinal axis and the axis of rotation of the air-water contact member 4 to be described is generally perpendicular to the direction of the air flow through the registers 2 or 3.

The humidifier apparatus includes a housing 5 including a water receptacle or reservoir 6 containing a supply of water 7 and a water supply container 8 which is preferably molded as an integral part of the housing 5 and is positioned on the inner surface 9 of the end 13 thereof. The level of the water 7 in the water receptacle 6 may be maintained at the desired height by merely turning the cap 31 in the appropriate direction to move it and the water dispensing element 32 thereon up or down on the threaded neck portion 33 of the water supply container 8.

The air-water contact member 4 is mounted for free rotation in journals or bearings 11 and 12 at the ends 13 and 14 of the humidifier housing 5. As shown, the air-water contact member 4 is mounted for rotation on a horizontal axis and is generally in the shape of a propeller which has been twisted at the midpoint of its longitudinal axis so that its end portions 15 and 16 lie in planes substantially perpendicular to each other. The frame 17 of air-water contact member 4 is preferably molded from a strong, lightweight plastic such as, for example, polystyrene. Mounted on the frame 17 of the air-water contact member 4 is porous water-absorbent covering 18. The water-absorbent covering on the air-water contact member may be chosen from a number of different materials such as, for example, an open-celled foam material, a woven cloth material, a non-woven fibrous sheet, or a mesh material. The moisture-absorbent covering of the air-water contact member may be made of cellulose or asbestos paper impregnated with a resin to achieve a desired wet strength. The impregnation being in an amount calculated to achieve the desired wet strength while still maintaining the desired absorbent characteristics. Other types of coverings for the air-water contact member known by those skilled in the art may also be used in the present invention.

As shown, the upper and lower portions of the ends of the frame 17 are desirably slightly curved in opposite directions to form generally an elongated S-shape. Obviously, the cross-sectional configuration of this member may be varied within reasonable known limits without substantially affecting the operation thereof.

Figure 3:
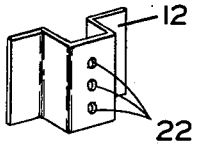
FIG. 3 is an isometric view of the fixed bearing member shown at the left end of the humidifier in FIGS. 1 and 2.
Figure 4:
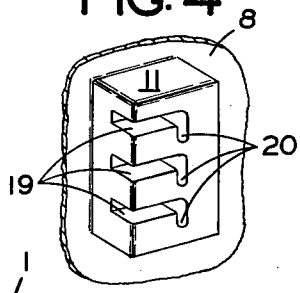
FIG. 4 is an isometric view showing the adjustable bearing shown at the right end of FIGS. 1 and 2.

Journal or bearing means 11 and 12 are provided at the ends 13 and 14 of the air-water contact member for removably and adjustably mounting it in the housing 5 to regulate to the desired extent its entry into the water 7 in the water receptacle 6. The bearing 11 at the end 13 of the humidifier housing 5 is preferably molded as an integral part of the water supply container 8, and, as shown, especially in FIG. 4, is provided with transfer slots 19 and depending grooves 20 adapted to receive the stub shaft 21 of the air-water contact member 4 therein. At the opposite end 14 of the humidifier housing 5 there is provided the bearing 12 (see FIG. 3) having holes 22 therein to receive stub shaft 23 on the opposite end of air-water contact member 4. Obviously, selection of the appropriate location of the stub shafts 21 and 23 and the grooves 20 in the bearing 11 and holes 22 in bearing 12 provides a means for raising or lowering the air-water contact member 4 with respect to the level of the water 7 in the receptacle 6. This, in turn, functions as a means of controlling the speed of rotation of the air-water contact member 4 in response to a given air velocity issuing from the register.

An important feature of the present invention is the configuration of the air-water contact member 4, and the fact that it is driven directly by the air stream passing thereover. As previously stated herein and as shown in the drawings, especially FIGS. 1 and 2, the air-water contact member 4 is generally in the shape of a propeller which has been twisted at the midpoint of its longitudinal axis so that its end portions 15 and 16 lie in planes which are substantially perpendicular to each other. The relationship of the planes of the end portions 15 and 16 of the member 4 may, however, be varied in the range of about 15 to 20 degrees without critically affecting the operation of the device.

It will be noted that the configuration of the air-water contact member 4 and the fact that it rotates around its longitudinal axis, results in only one-half of the contact member being in contact with the water in the reservoir at any given time. This further reduces resistance and air velocity requirements in its operation.

Figure 2:
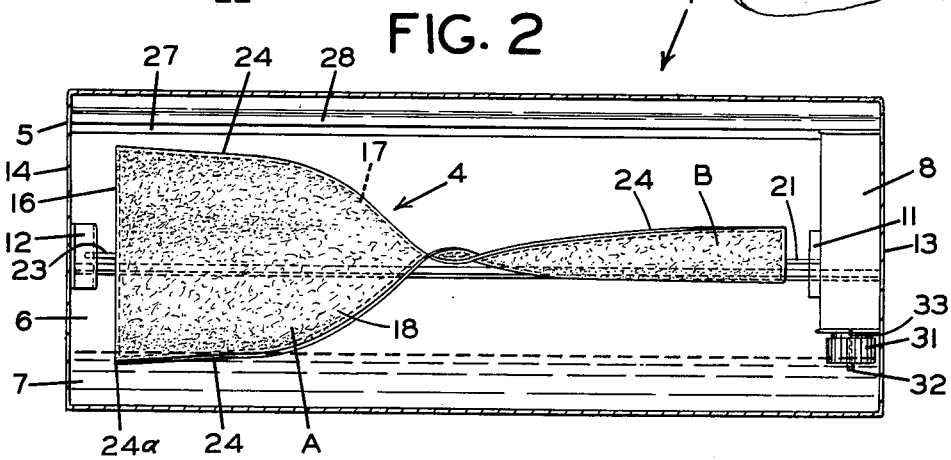
FIG. 2 is a front elevational view of the humidifier of FIG. 1 with the air outlet cover removed and the housing in section to show the components mounted herein.

As can be seen in the drawings, in FIG. 2, as the air-water contact member 4 turns, the tip 24*a* of vertical portion A thereof contacts the water 7 first, and then due to the incline of the edge portion 24, the edge 24 progressively enters the water 7 and passes therethrough in a kind of "slicing" action. This results in the air-water contact member 4 being able to pass through the water 7 with a minimum of resistance and with a very low air velocity requirement. It can be seen, that as the air-water contact member turns in the direction shown by the doted line arrow in FIGS. 5 and 6, it picks up water which, when one of the portions A or B therof is in a vertical position, allows the water to run down through the porous covering, thus providing a maximum of air-water contact at all times which, of course, provides a maximum evaporation situation. Also, as the water runs down, the weight of the water on the portions A or B is reduced and less air is required to drive the air-water contact member 4. Further, when no air is moving through the humidifier, this keeps the covering 18 wet longer and increases the output of moisture by evaporation. It will be noted that at least ¾ of the air-water contact member will extend at all times above the top surface of the water. Thus, a large portion of its surface area is exposed to the air stream flowing through the humidifier. This allows a maximum evaporation of water from the member as the air stream passes thereover.

As previously stated, the humidifier housing 5 may be molded from a lightweight plastic. The housing is preferably provided with knockout portion therein in a known manner which may be utilized to form openings 25 and 26 therein for use with a floor or wall register 2 or 3, respectively, as shown in FIGS. 5 and 6 to which air is supplied by means of appropriate duct work indicated generally at D. This enables the humidifier to be used in conjunction with a variety of room air outlet openings whether they be in a wall, the floor, or in a baseboard, recessed or not. Air deflecting and guide means 27 and 28 are provided in the housing 5 for directing the air stream from the register to the air-water contact member 4. As shown, the humidifier housing 5 also includes a combination exhaust air grill and access door 29. Hinge means 30 is provided for door 29 which may be operated manually through use of lift means 34.

While it is apparent that numerous modifications and embodiments may be devised by those skilled in the art, it is intended that the appended claims cover all such modifications and embodiments as fall within the true spirit and scope of the present invention.

What is claimed is:

1. An evaporator type humidifier adapted to be positioned in an air stream from an air-circulating system, said humidifier comprising (a) a housing having a water receptacle in the lower portion thereof and having an air inlet port and a humidified air outlet port;

(b) means mounted within said housing to supply water to said water receptacle and to maintain the water therein at a predetermined level; and (c) a single elongated air-water contact means horizontally mounted in said housing with its longitudinal axis transverse to the flow path of an air stream passing between the air inlet port and the air outlet port in the housing and being adapted to be rotated around its longitudinal axis by the direct impingment of the air stream thereon, said air-water contact means comprising a one-piece structure twisted at its midpoint region into substantially the shape of a propeller with the ends thereof being in planes which are substantially perpendicular to each other, the longitudinal axis of said structure extending from one of the ends thereof through its midpoint to the other end, said air-water contact means being so positioned in said housing that its rotation causes at least a portion of each longitudinal half thereof on opposite sides of its midpoint region to alternately pass through the water in the water receptacle.

2. A humidifier according to claim 1 wherein the ends of the air-water contact member are each generally in the shape of an elongated S and lie in planes which may vary from being perpendicular to each other in the range of from about 15 degrees to 20 degrees.

3. A humidifier according to claim 1 wherein said housing includes portions which may be removed to provide air inlet ports at the desired locations therein.

4. A humidifier according to claim 1 including air deflecting and guide means in said housing for directing the air stream from the air inlet port to the air-water contact member.

5. A humidifier according to claim 1 herein the housing includes a combination exhaust air grill and access door.

6. A humdifier according to claim 1 wherein the air-water contact structure comprises a frame with a water-absorbent covering theron and wherein the longitudinal edge portions thereof slope inwardly from its ends toward the midpoint of its longitudinal axis.

7. A humidifier according to claim 6 wherein the water-absorbent covering on the air-water contact member is a porous material.

8. A humidifier according to claim 1 wherein the housing is made of plastic and has a three-dimensional rectangular shape, and wherein the means for supplying water to the water receptacle comprises a container having water dispensing means on the bottom thereof, said container being molded as an integral part of the housing on the inner surface of an end wall portion thereof.

9. A humidifier according to claim 8 including bearing means located at each end of said housing for removably and adjustably positioning said air-water contact member relative to the level of water in the water receptacle, and wherein at least one of said bearing means comprises a plastic block molded integral with said water supply container on the outer surface of the inner wall thereof and having a plurality of vertically spaced horizontal slots extending from an edge thereof partially across the face of the block, each of said slots terminating in a depending groove adapted to receive a stub shaft on the air-water contact means therein.

* * * * *